US006430300B1

(12) United States Patent
Cox et al.

(10) Patent No.: US 6,430,300 B1
(45) Date of Patent: Aug. 6, 2002

(54) COOLING MECHANISM FOR AN AUDIO SPEAKER

(75) Inventors: Brian Cox, Somerville, MA (US); Aaron Linn, York, ME (US); Leif Blackmon, Medfield, WA (US)

(73) Assignee: Boston Acoustics, Inc., Peabody, MA (US)

( * ) Notice: Subject to any disclaimer, the term of this patent is extended or adjusted under 35 U.S.C. 154(b) by 0 days.

(21) Appl. No.: 09/404,451

(22) Filed: Sep. 22, 1999

(51) Int. Cl.[7] ..... H04R 25/00
(52) U.S. Cl. ..... 381/397; 181/199
(58) Field of Search ..... 381/396, 397, 381/412, FOR 152, FOR 159; 181/148, 156, 199

(56) References Cited

U.S. PATENT DOCUMENTS 4,590,332 A * 5/1986 Delbuck ..... 381/397
4,933,975 A * 6/1990 Button ..... 381/397
5,909,015 A * 6/1999 Yamamoto et al. ..... 381/397
5,940,522 A * 8/1999 Cahill et al. ..... 381/397

* cited by examiner

*Primary Examiner*—Curtis Kuntz
*Assistant Examiner*—Suban Ni
(74) *Attorney, Agent, or Firm*—Wolf, Greenfield & Sacks, P.C.

(57) ABSTRACT

A cooling mechanism is provided for an audio speaker, which mechanism includes a plate of a thermally conductive material mounted between the driver mechanism of the speaker and the speaker basket and extending from the voice coil gap to the outside of the speaker. The spacing between this plate and the voice coil is preferably kept as small as possible. The plate is preferably a vent plate having a plurality of radial vents extending along the width of the plate from the voice coil gap side thereof to the side facing the outside of the speaker. Such a vent plate, in addition to providing radiant cooling, also provides cooling via air flow as well as conduction and convection cooling. The vents are sized and shaped so as to minimize any turbulence, and thus any audible air noise.

8 Claims, 2 Drawing Sheets

COOLING MECHANISM FOR AN AUDIO SPEAKER

FIELD OF THE INVENTION

Figure 1:
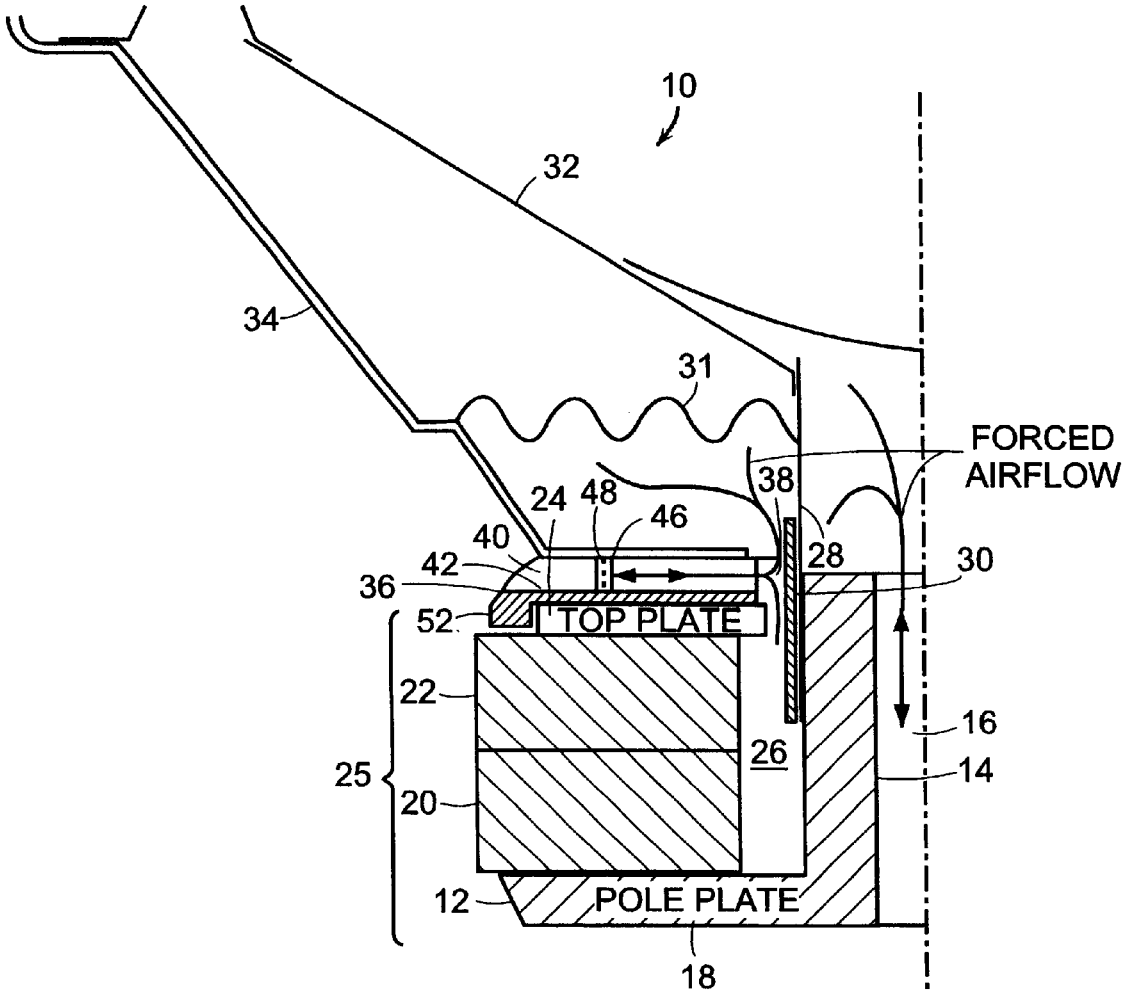

This invention relates to audio speakers, and more particularly to a mechanism for removing heat from such speakers.

BACKGROUND OF THE INVENTION

Driving an audio speaker above its rated power for a short period of time, or near its rated power for an extended period, in order for example to achieve high volume output, can result in overheating of the voice coil of the speaker which can adversely affect performance of the speaker and can cause damage, both to the voice coil and to other adjacent components. Such damage can require either expensive repairs or replacement of the speaker. While heavier duty voice coils can be used, this does not deal with potential thermal damage to other components of the speaker, and will generally result in greater heating of these other components. Heavier duty voice coils can also adversely affect response and other performance parameters of the speaker.

To overcome these problems, various techniques have been utilized in the past to either actively or passively cool the voice coil and other components of a speaker. Active cooling, generally involving the use of one or more fans, is expensive, requires a reasonable amount of space, and may introduce undesired background noise. Such cooling is therefore generally utilized only for large commercial applications and is not suitable for use in home or auto applications. Past attempts to introduce passive cooling to audio speakers have generally involved either mounting heat sinks to an existing component of the speaker drive mechanism, for example to the base plate, and/or arrangements to use movement of the speaker cone and/or spider to move air over the voice coil and other components of the speaker to be cooled, to some component of the speaker which can sink heat from such air. These efforts have met with varying degrees of success, frequently at a significant cost in speaker redesign, but many of these approaches have not been able to pass the heated air over a sufficient heat sink area to achieve significant cooling benefits. Further, many of these prior art approaches have relied on only a single mode of cooling, for example radiant cooling, and have therefore been less effective in cooling the speaker then if multiple cooling modes were utilized.

Further, air being moved through various parts of a speaker, and in particular over the voice coil thereof, can result in air turbulence which produces significant audible air noise. The extent to which this noise is objectionable is exacerbated when the speaker is mounted with its magnets and voice coil facing out of the enclosure, an arrangement which is becoming increasingly popular in automotive applications in order to enhance convection cooling of the speaker drive mechanism.

A need therefore exists for an improved cooling mechanism for an audio speaker which passively cools the voice coil and other components of the speaker utilizing multiple cooling modes with minimum added hardware, minimum added cost, negligible (if any) air turbulence (and thus substantially no audible air noise) and a significantly larger heat sink area over which heated air is passed than has generally been achieved in prior art mechanism.

SUMMARY OF THE INVENTION

In accordance with the above, this invention provides a cooling mechanism for an audio speaker of the type having a drive mechanism, a voice coil, and a basket over the drive mechanism, the basket having a spider and/or a speaker cone mounted therein, movement of the spider and speaker cone being controlled by the voice coil. The cooling mechanism includes a vent plate of a thermally conductive material mounted between the basket and the drive mechanism and extending around the voice coil, the vent plate having a plurality of radial vents, each of which vents extends from inside the plate adjacent the voice coil to the outside of the speaker. The thermally conductive material of the vent plate is preferably on at least three sides of each vent. A filter is preferably included in each vent to limit material flowing into the speaker through the vents, the filter preferably being a substantially cylindrical filter fitted in a circumferential groove formed in the vent plate between the inside and outside thereof. The drive mechanism normally includes top and bottom plates with at least one magnet therebetween, the top plate and magnets each being of a selected width, and the vents being of a length which is in substantially the same value range as such selected width. The vent plate is preferably dimensioned to be mounted closely adjacent the voice coil so as to facilitate radiant cooling of the coil. The vent plates are also designed to permit air flow therethrough with negligible air turbulence. In particular, all comers of the vent plate around which air flows are rounded and each vent has sufficient cross-sectional area to prevent turbulence of air flowing therethrough.

The vent plate is preferably a flat cylindrical housing of a thermally conductive material which housing has a hollow center portion in which the voice coil fits. The plurality of radial vents are formed in the housing extending from the hollow center portion to an outer wall of the housing, each of the vents having thermally conductive material of the housing on at least three sides thereof. The vent plate preferably includes a structure for receiving a filter for each vent which structure is, for a preferred embodiment, a circumferential groove formed in the housing between the center portion thereof and the outer wall. The hollow center portion of the vent plate is preferably dimensioned so that the vent plate is mounted closely adjacent the voice coil to facilitate radial cooling thereof and the vent plate is preferably designed so as to permit air flow therethrough with negligible air turbulence. As indicated above, such design includes all comers of the vent plate around which air flows being rounded and each vent having a sufficient cross-sectional area to prevent turbulence of air flowing therethrough.

In some applications a solid plate of a thermally conductive material may be substituted for the preferred vent plate, the solid plate being mounted between the drive mechanism and the basket, surrounding the voice coil, and being closely spaced therefrom.

The foregoing and other objects, features and advantages of the invention will be apparent from the following more particular description of a preferred embodiment of the invention as illustrated in the accompanying drawings, the same reference numerals being used for common elements in each of the drawings.

IN THE DRAWINGS

Figure 2B:
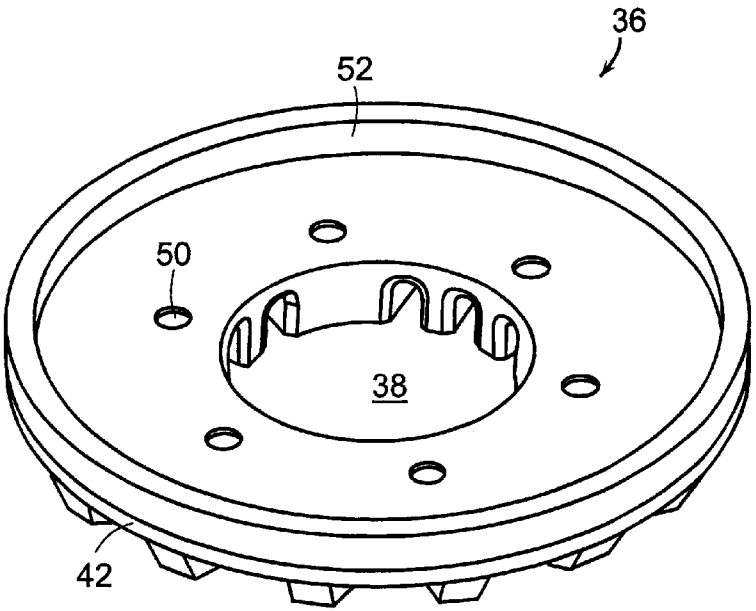
Figure 2A:
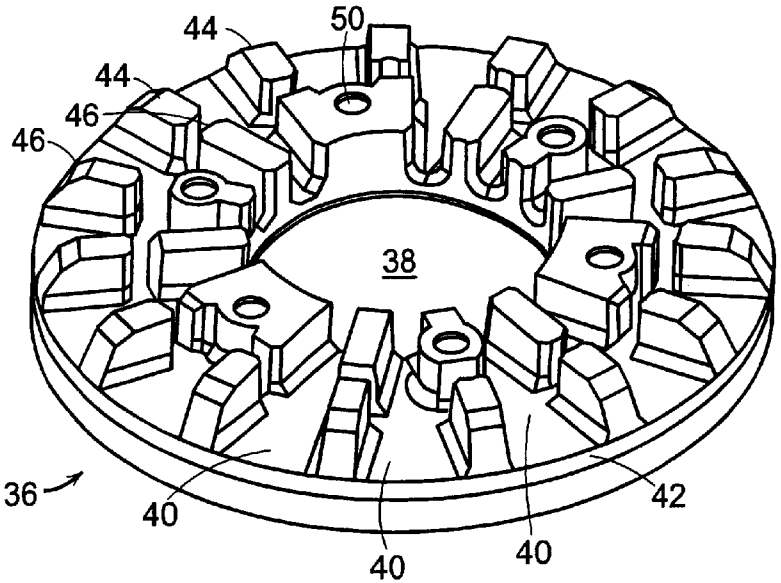

FIG. 1 is a partial sectional side elevation view of an illustrative speaker incorporating the cooling techniques of this invention; and FIGS. 2A and 2B are a top and bottom perspective view, respectively, of a vent plate suitable for use as a cooling mechanism in the speaker of FIG. 1.

DETAILED DESCRIPTION

FIG. 1 shows an illustrative speaker in which the teachings of this invention may be utilized. This speaker, only the part to the left of the center line being shown in the Figure, the right side being a mirror image of the left side, includes a pole plate 12 having a tubular center section 14 with a hollow central opening 16, and an extended bottom flange of plate 18. A pair of magnets 20, 22 are mounted on top of flange 18, the speaker drive mechanism or assembly 25 being completed by a top plate 24 positioned on magnet 22. Magnets 20, 22 and top plate 24 are in the form of disks having a center opening which surrounds projection 14 and is spaced therefrom to form a voice coil gap 26. A voice coil follower 28 having a voice coil 30 wrapped thereon is mounted in gap 26 and is attached at its upper end to the center of spider 31 and speaker cone 32. Spider 31 and speaker cone 32 are mounted at their far end to basket 34, which is positioned over speaker drive mechanism 25.

The speaker described above is a conventional speaker where current flowing in voice coil 30 in the magnetic field of drive mechanism 25 causes vertical movement of the voice coil and of voice coil follower 28 on which it is mounted, movement of the voice coil follower 28 resulting in corresponding movement of speaker cone 32 which provides the desired audio output. In order to achieve greater movement of cone 32, and thus higher volume output, more current must be applied to voice coil 30. However, current in voice coil 30 results in heating of the voice coil and of the surrounding components. Assuming some of these components, for example pole plate 18 and top plate 24, are of thermally conductive material, these components are effective in removing some of the heat from the speaker. However, if higher power is desired, additional cooling for the speaker may be required.

In accordance with the teachings of this invention, such additional cooling is provided by a vent plate 36 mounted between top plate 24 and basket 34 and having a hollow center opening 38 which is adjacent voice coil 30. As may be seen from FIGS. 2A and 2B, as well as FIG. 1, vent plate 36 is in the form of a flat disc-shaped housing of a thermally conductive material such as aluminum having opening 38 formed through the center thereof. Plate 36 has a plurality of substantially evenly-spaced radial vents 40 formed therein, each of which vents is defined by a base 42 of the housing and a pair of side walls formed by projections 44. Each of the projections 44 has a groove 46 formed therein, the grooves 46 forming a circumferential channel in which a cylindrical filter 48 may be mounted. Filter 48 prevents dirt and other undesired substances from being sucked into speaker 10 through vents 40. Certain of the projections 44 are of enlarged size to permit a screw hole 50 to be formed therein, screws passing through holes 50 being utilized to hold the speaker together. Plate 36 also has a lip 52 extending from the bottom of base 42 which, as can be seen in FIG. 1, extends over top plate 24.

In operation, vent plate 36 operates to cool speaker 10 in general, and voice coil 30 in particular, in a number of ways. First, vent plate 42 provides radiative cooling directly from coil 30 to the aluminum or other metal of vent plate 36. This is facilitated by making the inner diameter of the vent plate (i.e., the diameter of opening 38) close to the outer diameter of voice coil 30, thus improving heat radiation from the coil directly to the thermally conductive aluminum of the plate. The vent plate thus acts as part of the heat sink for coil 30.

The second mode by which heat is removed from the coil/speaker is by blowing air through the vent plate. Air is forced around the hot windings of coil 30 and out vents 40 when spider 31 moves down during each cycle, heat from the windings being shedded or sinked to the air, and the heated air being sinked to the thermally conductive surfaces of vents 40 as the air comes in contact with them. The more power that is put into voice coil 30, the more air is forced to move, and the more cooling is provided. During upward movements of spider 31, air is drawn into vents 40 from outside the speaker. This cooler air mixes with air in the vents, resulting in cooler air being drawn into the speaker to further cool the coil. Screen 48 reduces any dirt or other debris being drawn into the speaker along with the cooler air. The length of the vents 40, which is substantially equal to, or at least generally in the range of, the width of the driver assembly 25, is sufficient so that there is significant contact with thermally conductive material for air entering the vents, resulting in significant heat sinking of this air, and thus in significant cooling for the speaker.

As indicated earlier, one potential problem with forced air cooling is that the air movement can result in turbulence which causes audible air noise from the speaker. In order to minimize air turbulence and thus to substantially eliminate audible air noise, the vent plate is designed so that, as may be seen in the Figures, all comers thereof over which air passes are rounded, sharp comers being a potential cause of air turbulence, and the cross-sectional area of each vent across its entire length is sufficiently large to facilitate laminer rather than turbulent flow therethrough. All surfaces over which air passes are also smoothed and polished so as to eliminate burrs or any other turbulence inducing irregularities in such surfaces.

The third way in which vent plate 36 cools the speaker is through conduction. As the voice coil heats, the thin layer of air in contact with both the voice coil and the vent plate's inner diameter heats. The proximity of the voice coil and the vent plate facilitates heat transfer from the coil to the vent plate by conduction, by reducing the amount of air between the two parts. This conduction is facilitated by keeping a large surface area of the vent plate directly adjacent to the voice coil. This heat transfer by conduction does not rely on air movement forced by the spider and is effective for removing heat even when the coil is not moving (i.e. between numbers on a CD or other media, between disks on a multi-disc changer, etc.).

The fourth way in which vent plate 36 cools the speaker is through convection air flow.

Anywhere in the structure, but especially along vents 40 in vent plate 36, air that is warmer than surrounding ambient air will have a tendency to rise, to be replaced by the cool ambient air. This follows the principles of convection. The vent plate facilitates this circulation of air by providing a relatively unimpeded air path between the voice coil and air outside the drive mechanism. This effect is superimposed on the oscillating airflow when current is being applied to voice coil 30 to drive spider 31. Moreover, even during periods when current is not being applied to coil 30, so there is no air flow caused by movement of spider 31 (i.e., between numbers on a CD or other media, between disks on a multi-disc changer, etc.), convective cooling is facilitated for removing heat. In other words, the vent plate acts as a heat sink to the thermal control volumes, a) immediately around the coil and b) that includes the drive mechanism 25, voice coil and air inside the magnet structure (i.e., in the voice coil gap), increasing the rate of thermal transfer between these control volumes and the surrounding air volume. Thus, to the extent the temperature inside speaker 10 is at any time greater than ambient temperature, vent plate 36 is effective for removing heat from the speaker.

While at least because of the multiple modes of cooling which it provides, the vent plate 36 is clearly preferred for most applications requiring cooling of a speaker, there may be applications where radiant and/or conduction cooling alone is sufficient. Since optimum radial/conduction cooling is obtained by having as much heat sink material as possible adjacent the heat source, a solid ring of aluminum or other heat sink material without the vents 40 could be substituted for the vent plate 36 in such applications. In this case, it would still be desirable to have the spacing between the plate and the voice coil as small as possible. However, unless there is another source of venting, such as through opening 16, such a design could be noisy. Air flow to center channel or opening 16 could be achieved by providing openings in coil follower 28 through which such air flow could occur. While in the past heat sinking of voice coil 30 has been achieved through pole plate 12, magnets 20, 22 and/or top plate 24, the components of drive mechanism 25, the material of these components and their size and position are selected to achieve optimum drive performance. Any alteration in the materials, size and position of these various components in order to enhance or optimize heat sinking capabilities can compromise performance of the drive mechanism. It is therefore advantageous to provide a dedicated heat sink element adjacent the voice coil for performing the heat sink function, which element can be sized and positioned to achieve a desired level of heat sink performance without adverse affect on the performance of the drive mechanism.

A simple and inexpensive mechanism is thus provided for removing heat from an audio speaker, facilitating higher power operation thereof, without any adverse effect on speaker performance. While the embodiment shown and described is particularly adapted for use with a specific speaker configuration, the size, shape, and location of the vent plate will vary with the configure of the speaker in which it is being utilized and with the cooling requirements of the application. The vent plate may, for example, be thicker and/or the vents longer where greater cooling is required and the vents, rather than being exposed to heat sink material on three sides as shown for the preferred embodiment, may have heat sink material on all four sides. Separate filters may also be provided for each vent rather than a single cylindrical filter, other filtering mechanisms may be employed, or the filter may in some cases be eliminated. Thus, while the invention has been particularly shown and described above with reference to a preferred embodiment, the foregoing and other changes in form and detail may be made therein by one skilled in the art without departing from the spirit and scope of the invention which is to be defined only by the appended claims.

What is claimed is:

1. A cooling mechanism for an audio speaker of a type having a drive mechanism which includes top and bottom plates with at least one magnet therebetween, a voice coil and a basket over said drive mechanism, the basket having at least one of a spider and speaker cone mounted therein movement of the spider/speaker cone being controlled by said voice coil, the cooling mechanism including a dedicated vent plate independent of said drive mechanism, said vent plate being of a thermally conductive material, being mounted between said basket and the top plate of said drive mechanism, extending around said voice coil and having a plurality of radial vents, each vent extending from an inside of said plate adjacent said voice coil to an outside of said speaker.

2. A mechanism as claimed in claim 1 wherein thermally conductive material of said vent plate is on at least three sides of each said vent.

3. A mechanism as claimed in claim 1 including a filter in each said vent to limit material flowing into said speaker through the vents.

4. A mechanism as claimed in claim 3 wherein said vent plate has a circumferential groove formed therein between the inside and outside of the plate, said filter being a substantially cylindrical filter fitted in said groove.

5. A mechanism as claimed in claim 1 wherein said drive mechanism includes top and bottom is plates with at least one magnet therebetween, wherein said top plate and said at least one magnet are each of a selected width, and wherein each of said vents has a length in substantially the same value range as said selected widths.

6. A mechanism as claimed in claim 1 wherein said vent plate is dimensioned to be mounted closely adjacent said voice coil to facilitate radiant and/or conduction cooling of the coil.

7. A mechanism as claimed in claim 1 wherein said vent plate permits air to flow therethrough with negligible air turbulence.

8. A mechanism as claimed in claim 7 wherein all corners of said vent plate around with air flows are rounded, and wherein each vent has a sufficient cross sectional area to prevent turbulence of air flowing therethrough.

* * * * *

UNITED STATES PATENT AND TRADEMARK OFFICE

CERTIFICATE OF CORRECTION

PATENT NO. : 6,430,300 B1
DATED : August 6, 2002
INVENTOR(S) : Cox et al.

It is certified that error appears in the above-identified patent and that said Letters Patent is hereby corrected as shown below:

Title Page,
Item [75], Inventor, please correct "Leif Blackmon, Medfield, WA, (US)" to -- Leif Blackmon, Medfield, MA (US) --.

Signed and Sealed this

Thirty-first Day of December, 2002

JAMES E. ROGAN
*Director of the United States Patent and Trademark Office*